United States Patent [19]

Oppitz

[11] Patent Number: 4,600,486

[45] Date of Patent: Jul. 15, 1986

[54] ELECTRO-OSMOTIC MOVEMENT OF POLAR LIQUID IN A POROUS STRUCTURAL MATERIAL

[75] Inventor: Hans Oppitz, Mils, Austria

[73] Assignee: ELTAC Nogler & Daum KG, Innsbruck, Austria

[21] Appl. No.: 664,996

[22] Filed: Oct. 26, 1984

[30] Foreign Application Priority Data

Aug. 16, 1982 [AT] Austria ..... 3101/82

[51] Int. Cl.[4] ..... B01D 13/02

[52] U.S. Cl. ..... 204/182.3; 204/180.1; 204/182.2; 204/299 R; 204/290 R

[58] Field of Search ..... 204/299 R, 180 R, 290 R, 204/180.1, 182.3, 182.2; 428/255, 367, 372, 379

[56] References Cited

U.S. PATENT DOCUMENTS

| | | | |
|---|---|---|---|
| 3,523,884 | 8/1970 | Bagno | 204/180 R |
| 4,145,270 | 3/1979 | Moraru | 204/180 R |
| 4,154,430 | 5/1979 | Pfarr, Jr. | 428/255 |
| 4,208,696 | 6/1980 | Lindsay et al. | 428/367 |

*Primary Examiner*—John F. Niebling
*Assistant Examiner*—B. J. Boggs, Jr.
*Attorney, Agent, or Firm*—Kurt Kelman

[57] ABSTRACT

Reinforcing or carrier elements for plaster are used as electrodes in electro-osmotic dehumidification installations. The elements comprise a carrier body constituted by a flexible net having a surface of synthetic resin in contact with the plaster and the net has filamentary carrier materials incorporated therein. The synthetic resin is a conductive, essentially ion-free thermosetting resin of macromolecular structure, preferably an at least partially cross-linked acrylate polymer having a high surface roughness and containing a small amount of a plasticizer, and forms either the matrix or a coating of the flexible net. The filamentary carrier materials may be carbon or metal filaments. In the use of the dehumidification installation, a voltage alternating between a positive and a negative potential is conducted between the cathode and the anode, the time interval of the positive potential exceeding that of the negative potential.

6 Claims, 7 Drawing Figures

ELECTRO-OSMOTIC MOVEMENT OF POLAR LIQUID IN A POROUS STRUCTURAL MATERIAL

This is a division of my copending U.S. patent application Ser. No. 521,190, filed Aug. 8, 1983, now U.S. Pat. No. 4,500,410.

The present invention relates to a method for the electro-osmotic movement of a polar liquid in a porous structural material by electrodes to which an electric voltage is applied.

Reinforcing or carrier elements consisting of rod-shaped or net- or grid-like structures for structural materials are known. For example, structural steel mats or grids have been used for reinforced concrete bodies and fine metal grids have been used as reinforcing carriers for plaster and the like facings. For such use, the fine metal grids are frequently coated with burned ceramic masses to assure better adhesion of the plaster or mortar. One of the disadvantages of such metallic carrier grids is their exposure to corrosion. When such grids are arranged in zones of different pH-values, galvanic elements are frequently produced, creating electric fields leading to a destruction of the structural body and an attraction of humidity from the ground into the structural body. Such disadvantageous effects are encountered particularly when such plaster carrier grids are used in the renovation of old historical buildings whose walls are to be dried out. Therefore, it has often become necessary to build in electrodes of electro-osmotically operating dehumidification installations in addition to the plaster carrier grids to obtain the required dehumidification of the structural body.

Various methods for drying building walls are in use today. A research report of the Austrian Institute for Structural Research (Verlag Strassenbau, Chemie und Technik Verlagsgesellschaft mbH, Heidelberg, 1967) distinguishes the following: measures to be taken in connection with the plasterwork, airing methods, dehumidification bodies, incorportation of sealing layers, filling the pores, electro-osmotic and other methods. This invention belongs to the art of electro-osmotic methods and, therefore, the theoretical foundations thereof, as outlined in the report, will be outlined hereinbelow.

The electro-osmotic methods make use of the phenomenon of electro-osmosis to brake the humidity rising in the capillaries of masonry walls and to press it downwardly. Polarization occurs at the interface between water and a solid material, producing a negative charge on the surface of the solid material and a positive charge on the liquid drops. These electric charges (polarization) are normally not noticed but they cause a movement of the charged particles in an electric field, the solid material particles (as far as they are mobile) moving to the anode (this being also known as electrophoresis) while the liquid particles, especially if the solid material particles cannot readily move, tend to move to the cathode.

Since water always contains salts, it is conductive so that galvanic elements can be created by a suitable selection of the electrode materials to effect the electro-osmotic phenomena. The disadvantages include corrosion and a limited operating life of the electrodes while the installation has the advantage of requiring no maintenance.

In the active methods, an outside electric current supply is used to create the electric field between the electrodes. While this could also lead to corrosion, this problem has been overcome by using graphite or electrically conductive synthetic resins.

Various arrangements and compositions of electrodes have been disclosed in German Pat. Nos. 2,722,985 and 2,603,135 as well as Published German Patent Application Nos. 2,703,813 and 2,706,193. Published German Patent Application No. 2,706,172 proposes electrodes with additional films designed to prevent corrosion.

As has been disclosed in Published German Patent Application No. 2,705,814 and German Pat. No. 2,503,670, the upper limit of the voltage applied in the active method in dependence on the composition of the masonry and the salt content of the water is set by the decomposition voltage since an electrolysis would generate gases by the decomposition of the water, which destroy the structural parts, for example the plaster, into which the electrodes are built. It is pointed out in Published German Patent Applicatiion No. 2,705,814 that generated hydrogen peroxide gas may even constitute a danger of explosion so that an upper limit of 2.8 V is required. On the other hand, it would be desirable to increase the electric field by an increase in the applied voltage to improve the desired effect. This is particularly required in old or very thick masonry walls, or where the pressure of the rising humidity is considerable. Furthermore, an increase in the applied voltage will considerably increase the speed of the drying effect.

It is accordingly a primary object of the invention to provide a reinforcing or carrier element of the first-indicated type, which may be used in regions of different and/or changing pH-values and which make possible an intimate connection with the surrounding structural materials to use such reinforcing or carrier elements as electrodes for dehumidification installations operating on the basis of electro-osmosis. The reinforcing or carrier element for structural material comprises a carrier body constituted by a flexible net having a surface of synthetic resin in contact with the structural material, the net having conductive filamentary carrier materials incorporated therein. The synthetic resin is preferably a conductive, essentially ion-free thermosetting resin of macromolecular structure, for example an acrylate, and may either form the matrix of the flexible net or a coating thereof. The filamentary carrier materials are preferably conductive filaments of carbon or metal, which preferably are silver-coated.

The unexpected advantages of the invention include the fact that it provides a chemically neutral reinforcing or carrier element for structural material, which may be built into structural bodies regardless of various prevailing pH-values. They furthermore avoid creating electric fields by electrochemical decomposition so that they may be used in the renovation of old historical buildings whose structural bodies are very humid. At the same time, they may be used as electrodes for dehumidification installations based on electro-osmotic principles. Such net-like electrodes are particularly useful for building an electric field over large areas, the intimate connection between the carrier net and the surrounding structual materials additionally assuring an intensive building of the field over a long operating time. Even subsequent settling of the structural materials and/or the structural body do not interfere with the intensive building of the field. If some of the filaments of the net are broken, electric current supply remains assured by parallel filaments supplying power to the installation so that the electric field continues to function. At the same time, no disturbances can be created by electrolytic decompositions or hydrogen depositions on the anode even when the reinforcing or carrier elements of the invention are used in installations of large area and at higher operating voltages because at least the entire surface of the net consists of a conductive synthetic resin. The flexibility of the net assures a full adaptation thereof to different environments, such as different ground or structural body levels. This advantage is noted especially when the reinforcing or carrier elements of the present invention are used in the renovation of very humid structural bodies. Since the coating of the net with the conductive synthetic resin causes a uniform voltage discharge over the entire area of the electrode, an electro-kinetic effect, for example electro-osmosis, over a large area is obtained.

The above and other objects, advantages and features of this invention will be better understood from the following detailed description of certain now preferred embodiments thereof, taken in conjunction with the generally schematic drawing wherein FIG. 1 is a top view of a net-like reinforcing or carrier element for structural material according to the invention;

Figure 1:
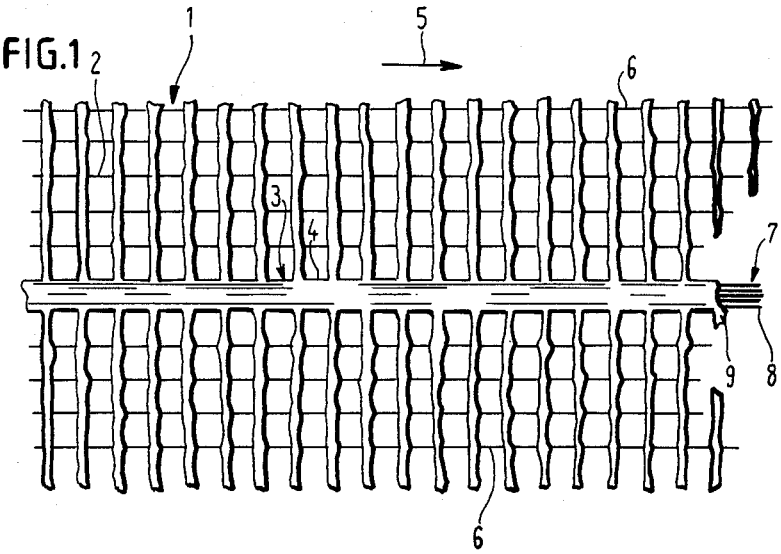

Referring now to the drawing and first to FIG. 1, there is shown a reinforcing or carrier element for structural material, such as plaster or the like, comprising carrier body 1 constituted by flexible net 2. In the illustrated embodiment, net 2 comprises electric power supply conductor 3 as an integral part thereof and this conductor is constituted by band 4 consisting of a plurality of flexible wires 7 embedded in synthetic resin 9. As shown, the net is band-shaped and extends in a longitudinal direction indicated by arrow 5 and electric power supply conductor 3 extends in this direction centrally between respective longitudinal edges 6 of the band-shaped net. The flexible wires may be metal filaments 8 which may be silver-coated. The use of titanium wires will assure good conductivity while keeping the potential differential between the surface of metal filaments 8 and surrounding synthetic resin 9 low. If the potential differential is low, no electromotive force and, therefore, no current flow will be created between the different materials, i.e. the silver-coated or titanium wire 8 and the synthetic resin 9. Accordingly, the metal will not be decomposed, particularly metals whose own potential is more negative, so that no ions will go into solution in the surrounding synthetic resin. The resin will remain ion-free. If desired, carbon filaments preferably coated with silver may also be used in the electric power supply conductor instead of the metal filaments.

The illustrated electric power supply conductor enables this carrier element to be uniformly supplied with electric current when used as an electrode and such electrodes may be built in subsequently to produce electric fields in building bodies to provide barriers against the spread of humidity. The use of preferably silver-coated carbon filaments or metal filaments, such as titanium filaments, in the electric power supply conductor increases not only the strength of the net but also its conductivity. The central arrangement of the electric power supply conductor assures the uniform supply of current to all parts of the band-shaped net and enables damaged net parts to be readily bridged.

The flexible net preferably has a mesh size adapted to the structural material reinforced and carried thereby and the mesh width is preferably about 5 mm if the carrier element is used for plaster. This will enable the plaster to be placed on the carrier element without damage thereto.

Figure 2:
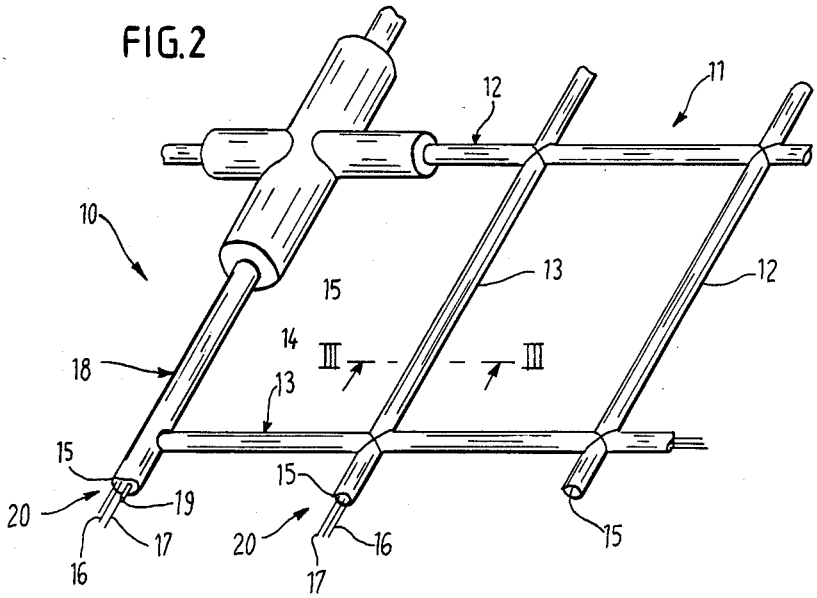
FIG. 2 is a fragmentary perspective view of another embodiment of the element of FIG. 1.

FIG. 2 shows flexible net 11 comprising carrier body 10. Strands 12 to 14 of net 11 consist of synthetic resin 15 which is a conductive, essentially ion-free thermosetting resin of macromolecular structure. The preferred synthetic resin is an at least partially cross-linked acrylate polymer having a high surface roughness and containing a small amount of a plasticizer. A useful synthetic resin for the purposes of the present invention has been disclosed in my Austrian Pat. No. 313,588 whose disclosure is incorporated herein by way of reference. It is of advantage to use a synthetic resin doped with a oxygen-reducing metal, such as titanium or boron. When a net comprised of such a doped synthetic resin is used as an anode in an electro-osmotic dehumidification installation, oxidation of the anode and its concurrent loss of activity is avoided. The high surface roughness of the synthetic resin has the advantage of providing good adhesion between the carrier body and the structural material, such as plaster, carried thereby and surrounding it. Incorporating a small amount of plasticizer in the synthetic resin assures that the synthetic resin matrix or coating does not shrink so that this adhesion is maintained. Thus, good contact is maintaned for a long time between the carrier element and the surrounding structural material when such carrier elements are used as electrodes in dehumidification installations. This effect is further enhanced with the use of the doped synthetic resins which avoid the fouling of the anode during operation.

If the synthetic resin wherein the filamentary carrier material 20 is embedded is a semi-conductor containing a relatively small amount of carbon particles freely floating in the synthetic resin, the electrical charges are carried by electrons and holes, in contrast to so-called ion semi-conductors wherein the charges are carried by the substance. Such reinforcing or carrier elements have a particularly good conductivity under the temperature conditions prevailing in buildings. Since the carbon particles, which enhance the conductivity of these semi-conductors, need not form a skeleton for the carrier element, small amounts of carbon suffice, which reduces the brittleness of such synthetic resin structures. To increase the mechanical strength of the net as a carrier element for structural material and to increase the conductivity of the net for use as an electrode, metal or carbon filaments 16 and 17 are incorporated in synthetic resin matrix 15 of the net so that the surface of the flexible net in contact with the structural material it carries, such as plaster or the like (not shown), consists of the synthetic resin.

In the embodiment of FIG. 2, strand 14 of net 11 constitutes electric power supply conductor 18, the mechanical resistance and electrical conductivity of the conductor being enhanced by incorporated carbon or metal filaments 16, 17 shown to carry silver coating 19. If desired, the conductivity of the entire net may be enhanced by coating all filaments embedded in the synthetic resin of the net with silver whereby the electric field will be made stronger over the entire area of the net.

It is within the scope of this invention to use any conductive synthetic resin for the manufacture of flexible net 11, which is highly elastic and may be readily bent without snapping back to its original shape, i.e. which is shape-retaining. This considerably improves the adaptability of the carrier element and enables the structural material to be readily applied thereto so that the entire assembly may conform to various surface configurations of structural bodies on which it is mounted as a facing.

The entire net may then be coated with synthetic resin 15, as has been shown by way of example at the intersection of strands 12 and 14 of net 11. Carbon or metal filaments 16, 17 serve not only to enhance the electrical properties of the carrier body but filamentary carrier material 20 constituted by these filaments also reinforces the flexible net. While any suitable material may be used for filamentary carrier materials 20, carbon and metal filaments are preferred because, for the preferred use as an electrode in electro-osmotic dehumidification installations, such filaments combine good conductivity with high strength.

Figure 3:
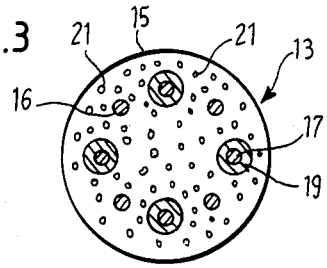
FIG. 3 shows a strand of the net-like element in section, along line III—III of FIG. 2.

FIG. 3 shows an enlarged cross section of strand 13 of net 11. As shown, metal filaments 16 and carbon filaments 17 are embedded in synthetic resin matrix 15, the carbon filaments having silver coatings 19. As also shown, freely floating and randomly distributed carbon particles 21 are distributed throughout the synthetic resin matrix, this arrangement being possible because the synthetic resin has semi-conductor properties and the carbon is not required to provide a conductor system but merely serves to increase the conductivity.

Figure 4:
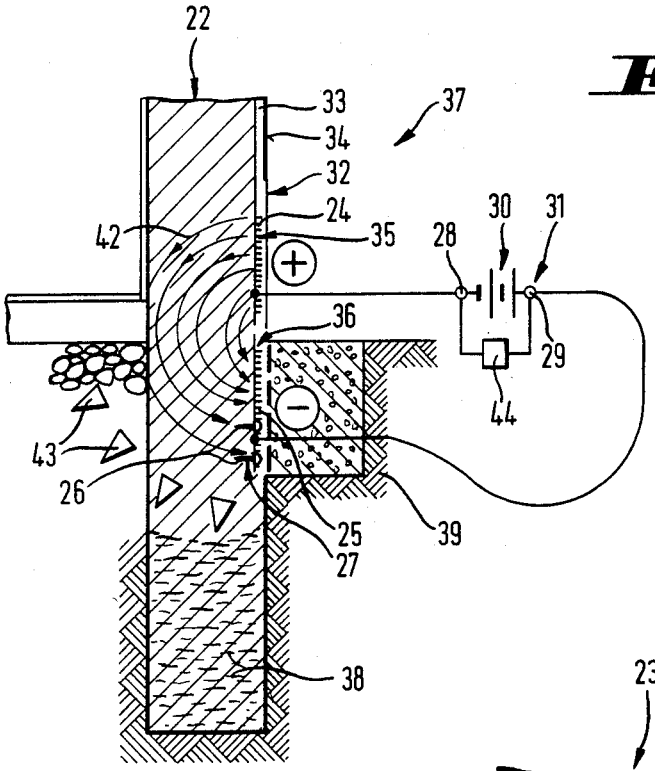
FIG. 4 illustrates an arrangement of the net-like element as electrodes for a dehumidification system.
Figure 5:
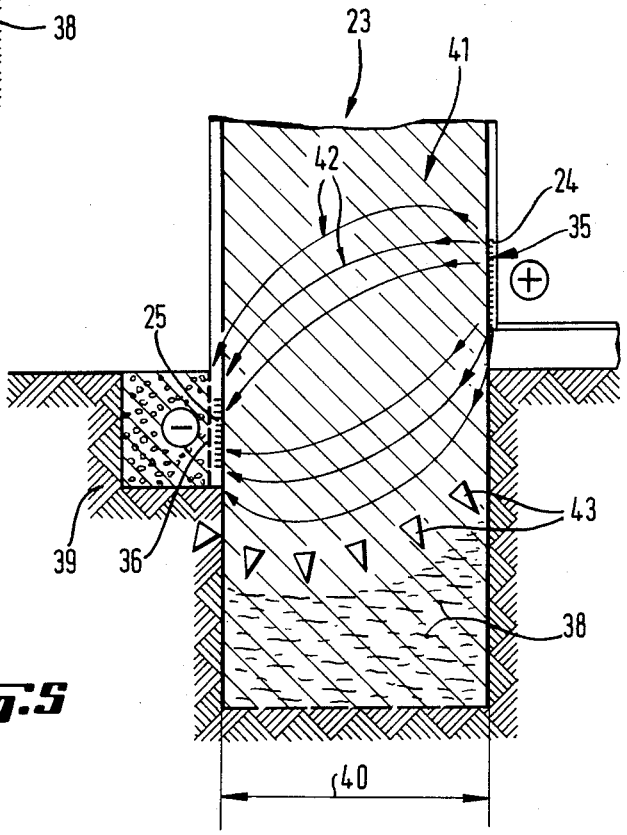
FIG. 5 illustrates the use of such electrodes in an electro-kinetic installation operating on the electro-osmotic principle.

FIGS. 4 and 5 show two installations with different arrangements of the reinforcing or carrier elements of this invention on structural bodies constituted, for example, by a brick or reinforced concrete wall.

In the embodiment of FIG. 4, two flexible nets 24 and 25 are mounted on a surface of structural body 22, being affixed thereto by suitable fastening means 27, such as synthetic resin studs. The two nets constitute a cathode and an anode, respectively, of voltage supply 31 for an electro-osmotic or electro-kinetic dehumidification installation 37 for the structural body, the two nets being arranged one above the other in a vertical direction. The voltage supply comprises direct current source 30 having positive pole 28 and negative pole 29, and lower net 25 is connected to the negative pole while upper net 24 is connected to the positive pole of the direct current source. After these connections have been made, plaster or the like is applied as the structural material to the two nets to cover the surface of structural body 22. The structural material is applied in a sufficient thickness to embed nets 24 and 25 entirely therein, i.e. so that the nets lie below surface 34 of the structural material layer. Net 25 constituting cathode 36 is arranged in foundation 39, the soil in the range of the cathode preferably having been replaced by a porous, water-permeable layer capable of permitting water to be removed from around the foundation. The vertically superimposed arrangement of the two electrodes on the outside of structural body 22 provides an effective horizontal barrier against the rise of humidity 38 from the foundation of the structural body. Since the anode is arranged above the cathode and the humidity within the structural body travels in the direction of the cathode, the humidity cannot rise fron the foundation, as symbolically shown by arrows 43. The electric field generated between the electrodes is indicated by field lines 42.

In the embodiment of FIG. 5, wherein like parts operating in a like manner are designated by the same reference numerals as in FIG. 4, the considerable thickness of structural body 23 makes it desirable to mount carrier element 24 constituting anode 35 on the interior surface of the structural body facing the inside of the building while carrier element 25 constituting cathode 36 is mounted on the exterior surface facing the atmosphere. As in the embodiment of FIG. 4, the cathode is mounted in the foundation and an intensive electric field 41 is generated when the electrodes are connected to direct electric current source 30, which is schematically indicated by field lines 42.

To avoid a depolarization of the anode and a concomitant weakening of the conductivity, which would decrease the strength of the electric field generated between the electrodes, pole reversal switching member 44 is associated with direct electric current source 30 and is arranged between upper net 24, i.e. the anode, and the direct current source. This switching member has the result of periodically and in short intervals reversing the polarity of electro-kinetic installation 37. In this manner, a voltage alternating between a positive and a negative potential is conducted between cathode 36 and anode 35. As a result, the ions in the electric field cannot be deposited and depolarization is avoided. The high conductivity in the structural body prevents salt ions traveling between the electrodes from being deposited and the large current flow assures building of a very intensive electric field, causing a correspondingly strong flow of water in the direction of the cathode, i.e. out of the structural body.

The use of like electrodes avoids the disadvantages of an electrolytic decomposition on the basis of potential differentials in the structure. Furthermore, the installation may be operated with relatively low voltages since the switch effecting a reversal of the polarity will prevent electrolytic depositions on the anode.

It is also possible to arrange the two electrodes at two different levels relative to foundation 39 and to ground them together whereby the natural potential differential is balanced and a horizontal barrier is produced to prevent the humidity from migrating beyond the level of the electrodes.

Since the synthetic resin of the reinforcing or carrier element of the present invention preferably has a high surface roughness and low shrinkage, the adhesion of the plaster to the synthetic resin element will remain strong for a long time, thus avoiding any collection of humidity and concomitant corrosion in the range of the electrodes while assuring a high conductivity.

Figures 6, 7:
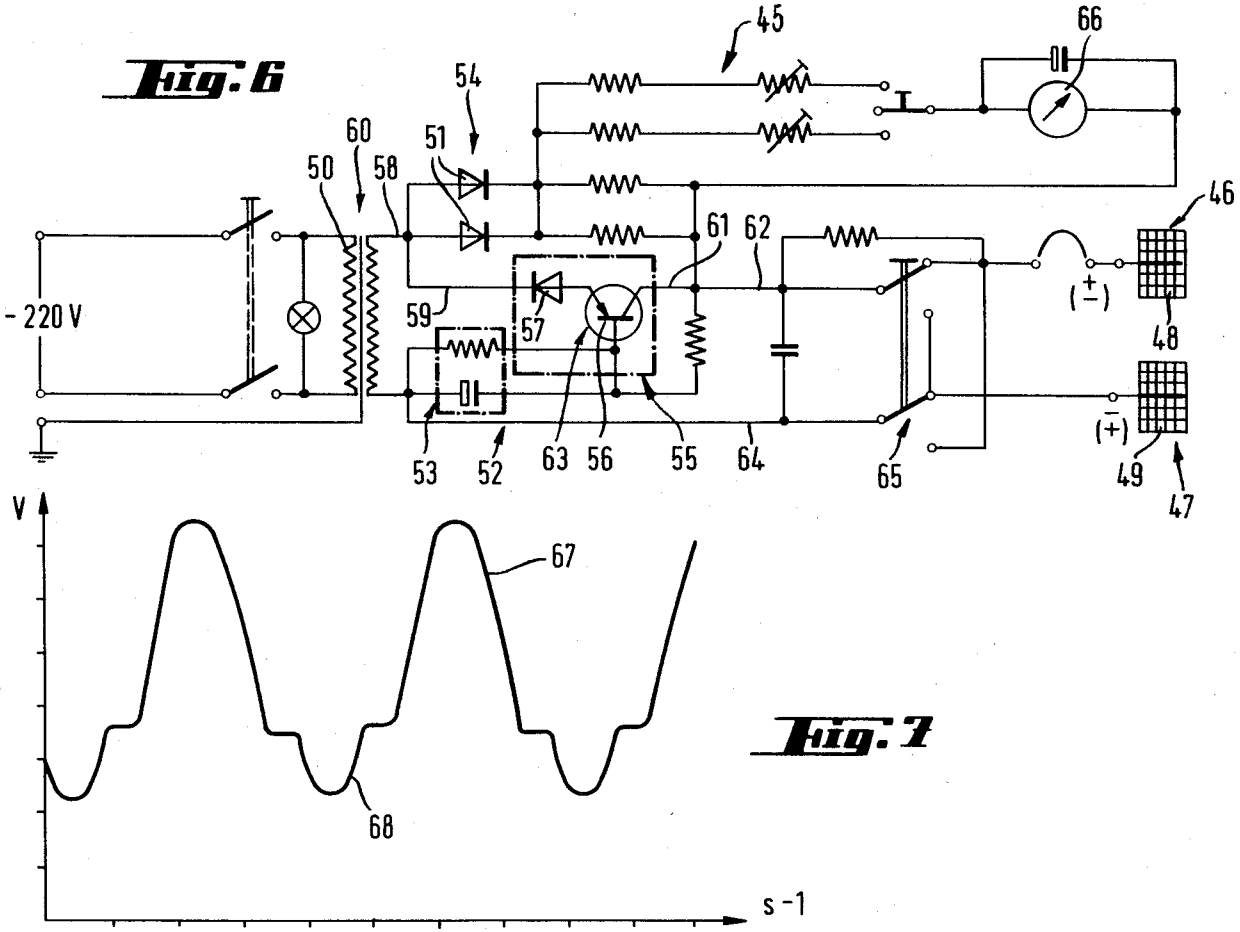
FIG. 6 is a circuit diagram of a voltage supply system for such an electro-kinetic installation.
FIG. 7 shows a voltage time curve for the alternating negative and positive voltage applied to the electrodes.

FIG. 6 shows voltage supply circuit 45 for anode 46 and cathode 47 constituted, respectively, by nets 48 and 49 of the present invention. This circuit comprises transformer 50, direct current smoothing diode 51, polarity reversal switching member 52 and timing member 53. The switching member has electric pulse switch 55 arranged parallel to smoothing diode 51 of rectifier circuit 54. The switch is constituted by transistor 56 and has input 59 connected to negative pole 58 of direct current source 60 constituted by transformer 50 and output 61 connected to transmission line 62 leading to anode 46. Transistor 56 serving as closing contact for the pulse switch is actuated by timing member 53. The timing member enables the transistor to permit passage of the current for a predetermined time interval. Diode 57 associated with polarity reversal switching member 52 assures voltage passage only when a negative potential is applied to output 58 of transformer 50.

Further switch 65 is arranged between transmission line 62 leading to anode 46 and transmission line 64 leading to cathode 57 so that, if and when desired, the polarity of nets 48 and 49 may be reversed, the anode becoming the cathode and the cathode becoming the anode. Also, current indicating device 66 is connected to voltage supply circuit 45 to enable the current flow and voltage to be read. Any suitable type of voltage supply circuit may be used within the scope of this invention and the transistor circuit may, for example, be replaced by a relay control or an integrated circuit in a microprocessor or the like. Thus, this type of voltage supply circuit has the advantage of being able to make use of various technologies best designed to fit the conditions under which the system is used.

FIG. 7 shows a preferred form of the voltage supply curve in a method for the electro-osmotic movement of a polar liquid in a porous structural material reinforced or carried by the two electrodes of the invention. In this method, a voltage alternating between a positive and a negative potential is conducted between the cathode and anode, the time interval of the positive potential exceeding that of the negative potential and the positive potential preferably exceeding the negative potential. This produces the desired electro-osmotic effect while the short application of the negative potential eliminates any electrolytic decomposition products, such as undesired gases. The high concentration of the substances generated at the electrodes effects a rapid and preferred reversal of the chemical reactions while any build-up of a reversed electric field and thus the reversal of the electro-osmotic effect is reduced or fully avoided.

The requirement of different time integrals for the positive and negative potentials may be met by providing different time intervals and/or different voltages for the positive and negative voltage portions. It is particularly advantageous if the alternating potential is a sinusoidal voltage of an existing electric current supply net and the negative potential of the supplied electric current is reduced. FIG. 7 shows positive sinusoidal curve 67 of a suitably down-transformed electric current obtained from an existing electric current supply net while negative potential portion 68 of the sinusoidal curve has been reduced by cutting off the voltage peak of the negative potential. Thus, as long as the negative potential portion of the original sinusoidal curve does not exceed a predetermined voltage, no potential is applied to the electrodes. Only a portion of the sinusoidal voltage exceeding the predetermined voltage is conducted to the cathode and anode. This may be readily realized by semiconductors. The sinusoidal voltage of the positive potential preferably exceeds 6 V. While the use of the net frequency has great advantages, the method of the present invention is not limited to sinus voltages of 50 or 60 $s^{-1}$.

The preferred voltage time curve shown in FIG. 7 may be readily obtained with voltage supply circuit 45 illustrated in FIG. 6. Passage of potential through transistor 56 is opened by a condenser arranged in timing member 53 only after positive potential has been applied for a certain time interval so that negative potential is applied to anode 46. The timing member is so constructed that this application of negative potential to transmission line 62 leading to the anode is blocked again when the potential is below the pre-selected voltage level. This produces the voltage curve shown in FIG. 7.

For the best operation of the dehumidification system using the electrodes of the invention, it is preferred to arrange the electrodes at a minimal distance of about 10 cm along the height of the structural body. Furthermore, it is preferred to mount the cathode about 30 to 50 cm below ground level. It is of great importance for the effective operation of the system in connection with power supply circuit 45 to make certain that the charge at any point of the electrode is such that the voltage and amperage of the applied current produces no more than negligible amounts of oxygen, never reaching a level of magnitude sufficient to destroy the electrode elements.

The advantage of using the reinforcing or carrier elements of the present invention as electrodes in electro-osmotically operating dehumidification installations resides not only in the increased desired effect obtained in a fraction of the time in which success is achieved even at high water pressures in old and thick building walls but also in the dependable avoidance of the chemical decomposition of the water leading to the evolution of undesired gases and the precipitation of heavy metal, which may lead to the destruction of the structural materials. The measured effective voltages of the positive portion of the alternating voltage may be more than 16 V. Even with such high voltages, the conductive or semi-conductive synthetic resin of the carrier elements is not corroded.

Operating the disclosed system in accordance with the method of this invention produces an effective electro-osmotical dehumidification producing optimal results when the described steps are followed.

What is claimed is:

1. A method for the electro-osmotic movement of polar liquid in a porous structural material in contact with two carrier bodies each constituted by a flexible net having a surface of synthetic resin, the net having conductive filamentary carrier materials incorporated therein, and the nets respectively forming a cathode and an anode, comprising the step of conducting a voltage of a positive and a negative potential between the cathode and anode for alternating time intervals, the time intervals of the positive potential exceeding those of the negative potential.

2. The method of claim 1, wherein the positive potential exceeds the negative potential.

3. The method of claim 1, wherein the alternating potential is a sinusoidal voltage of an existing electric current supply net and the negative potential of the supplied electric current is reduced.

4. The method of claim 3, wherein the negative potential is reduced by cutting off the voltage peak of the negative potential.

5. The method of claim 4, wherein only a portion of the sinus voltage exceeding a predetermined voltage is conducted to the cathode and anode, and the sinus voltage of the positive potential exceeds 6 V.

6. The method of claim 1, comprising the further steps of first mounting the flexible nets on a surface of a structural body and connecting it thereto by an electrochemically resistant material, and then applying plaster or the like as the structural material to the net to cover the structural body surface before the alternating voltage is conducted between the cathode and anode.

* * * * *